United States Patent [19]

Fremion

[11] 4,392,606

[45] Jul. 12, 1983

[54] PRE-BANDED BULK PACK CONTAINER

[75] Inventor: Edwin A. Fremion, Cleveland, Tenn.

[73] Assignee: Westvaco Corporation, New York, N.Y.

[21] Appl. No.: 331,555

[22] Filed: Dec. 17, 1981

[51] Int. Cl.[3] ..... B65D 19/06; B65D 19/20

[52] U.S. Cl. ..... 229/23 R; 206/600; 220/416; 229/37 R

[58] Field of Search ..... 206/595–600, 206/386, 499, 505, 517, 577; 229/23 R, 37 R; 220/416, 441, 443, 468; 217/12, 13, 43 A; 108/51.1, 51.3, 53.3, 56.1, 56.3

[56] References Cited

U.S. PATENT DOCUMENTS

| | | | |
|---|---|---|---|
| 2,085,465 | 6/1937 | Hultin | 229/37 R |
| 2,665,047 | 1/1954 | Belsinger | 220/468 |
| 2,759,654 | 8/1956 | Lugt, Jr. | 220/416 |
| 2,806,594 | 9/1957 | Muller et al. | 206/600 |
| 2,847,120 | 8/1958 | Miller et al. | 206/597 |
| 2,973,119 | 2/1961 | Parker | 220/441 |
| 3,007,622 | 11/1961 | George | 229/23 R |
| 3,291,364 | 12/1966 | Fischer | 206/600 |
| 3,533,546 | 10/1970 | Kossnar | 229/37 R |
| 3,726,467 | 4/1973 | Shepherd | 229/23 R |
| 3,744,702 | 7/1973 | Ellison | 229/23 R |

*Primary Examiner*—George E. Lowrance
*Assistant Examiner*—Jimmy G. Foster

[57] ABSTRACT

A bulk material container, adapted to be supported on a pallet or the like, comprising a collapsible body portion and upper and lower end caps. The collapsible body portion is prepared from a pair of blanks of corrugated paperboard scored to form a plurality of side walls having coterminous upper and lower edges. The blanks of paperboard are superimposed on one another and interleaved to produce a construction wherein the unsecured ends of each respective blank are separated from one another by a corner of the other respective blank. The body portion is pre-banded in the collapsed condition with two or more support straps which provide restraint for the side walls when the body portion is squared and filled.

6 Claims, 9 Drawing Figures

PRE-BANDED BULK PACK CONTAINER

BACKGROUND OF INVENTION

The present invention relates generally to containers and more particularly to a container for storing and shipping bulk materials such as powdered or granular products.

Bulk pack containers have been developed and are available with liners (both glued in place and unglued) that perform well with loads up to about 1,500 pounds. However, when the loads exceed 1,500 pounds and approach 2,000 pounds, such bulk packs tend to bulge excessively. One of the solutions for this problem is simply to apply perimeter bands or straps to such packs to help hold the sidewalls vertical to keep the corners from splitting and to increase the stacking strength. Another solution has been to form compartments within the containers to better distribute the forces among more side walls. Yet another solution has been to form the bulk type containers with multiple side walls, i.e., an octagonal shape. However, the problem with such odd shaped containers is that they create void space in warehouse storage and shipping. A list of U.S. patents which disclose containers of the type described above is set forth below:

3,063,615
3,115,292
3,880,341
4,013,168
4,037,775
4,040,558
4,089,417
4,177,935
4,186,846
4,260,071

The containers disclosed in the aforementioned patents are suitable for most purposes, but they suffer in many respects, particularly with respect to the way they are manufactured and set up for use. Meanwhile, in accordance with other aspects of container design it is known in the prior art to provide preliminary banding steps for reinforcing shipping containers as shown by the following U.S. patents:

1,706,814
3,010,633

Notwithstanding, the present invention provides a unique solution to the various problems found in the prior art bulk pack containers and does so with a simplicity of design and construction not anticipated by the prior art.

SUMMARY OF INVENTION

In order to overcome some of the problems inherent in the prior art bulk pack containers, the present invention provides an improved bulk material container comprising, in combination, a collapsible body portion and a pair of upper and lower end caps, all adapted to be supported by a wooden pallet or the like. The end caps are of substantially conventional construction and may be prepared in any convenient manner. However, the body portion of the present invention is of novel construction, and in combination with the end caps, provides a superior bulk pack container which is relatively inexpensive and easily set up for use. In this respect, the body portion of the bulk pack container of the present invention is prepared from at least two blanks of material such as corrugated paperboard that are scored to form a plurality of side walls. The preferred shape for the body portion is a quadrilateral wherein all sides may be of the same size or only the opposed sides may be of the same size. In any event, the blanks are of substantially identical construction such that the corresponding side walls formed in each blank by the score lines are of about the same size. The blanks further have coterminous upper and lower edges and unsecured ends in the final construction, and the blanks are not adhered together as is common in the prior art. The body portion of the bulk bin container described herein is constructed by combining at least two of the substantially identical blanks such that a first pair of corresponding side walls are superimposed one over the other with the remainder of the respective blanks extending outwardly beyond the superimposed portions. At this point, the remaining side walls of each respective blank are folded over and interleaved with respect to one another to produce a construction wherein the unsecured ends of each blank are separated from one another by a corner of the other respective blank. In this condition, the blanks are collapsed and pre-banded with strapping material in the conventional manner. However, when squared for use, the unsecured ends of each blank end up on diametrically opposed corners of the body portion.

It is anticipated that the pre-banded body portion and the respective end caps may be shipped to the user in the collapsed condition for set up and use. However, it is possible for the user to apply the bands at the point of use to the collapsed and interleaved blanks, and to obtain end caps from any other convenient source. In any event, the body portion is pre-banded in the collapsed condition to take advantage of the novel features of the present invention.

It is also anticipated that where desired, one or both blanks may be provided with end flaps along one edge. When blanks of this construction are interleaved together, it is possible to produce a body portion with upper and lower flaps. Such a construction is particularly desirable when the bulk container is designed for a very fine, dense product that even when packaged in an inner plastic bag, still tends to creep under the bottom edges of a body portion without end flaps. In this connection, it is understood that in most cases, the product will be packaged in an inner plastic bag whether or not end flaps are specified.

Accordingly, it is an object of the present invention to provide an improved bulk material container that may be readily set up at the point of use.

A further object is to provide a bulk material container having double thick walls but no exposed seams while eliminating the conventional manufacturers joint normally used to make containers of the type disclosed.

Another object of the invention is to provide a relatively inexpensive bulk material container that has a pre-banded body portion to give the container anti-bulge and anti-tear features while still being capable of supporting other containers stacked on top.

Yet another object of the invention is to provide a corrugated bulk material container which possesses superior strength but which does not have laminated or glued together side walls as is common in the prior art.

With the above and other objects in view that will appear hereinafter, the nature of the invention will be more clearly understood by reference to the following detailed description, the appended claims, and the several views illustrated in the accompanying drawing.

DETAILED DESCRIPTION

Figure 8:
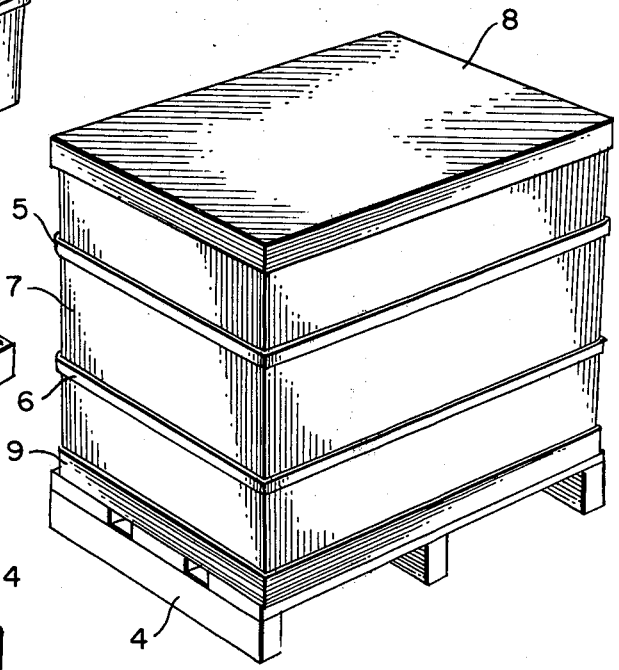
FIG. 8 is a perspective view of the final container.

The bulk bin container of the present invention shown generally in FIG. 8 includes a top end cap 8, a bottom end cap 9 and a body portion 7 pre-banded with reinforcing straps 5,6 and adapted to be supported on a wooden pallet or the like 4. The preferred shape for the bulk container is generally rectangular in cross section, but it may be made square if desired. The top and bottom end caps 8,9 are prepared in any convenient manner and their specific construction is not a part of the present invention. Meanwhile, the body portion 7 is preferably prepared from at least two blanks of corrugated paperboard to produce a reinforced construction.

Figures 1, 2, 3, 4:
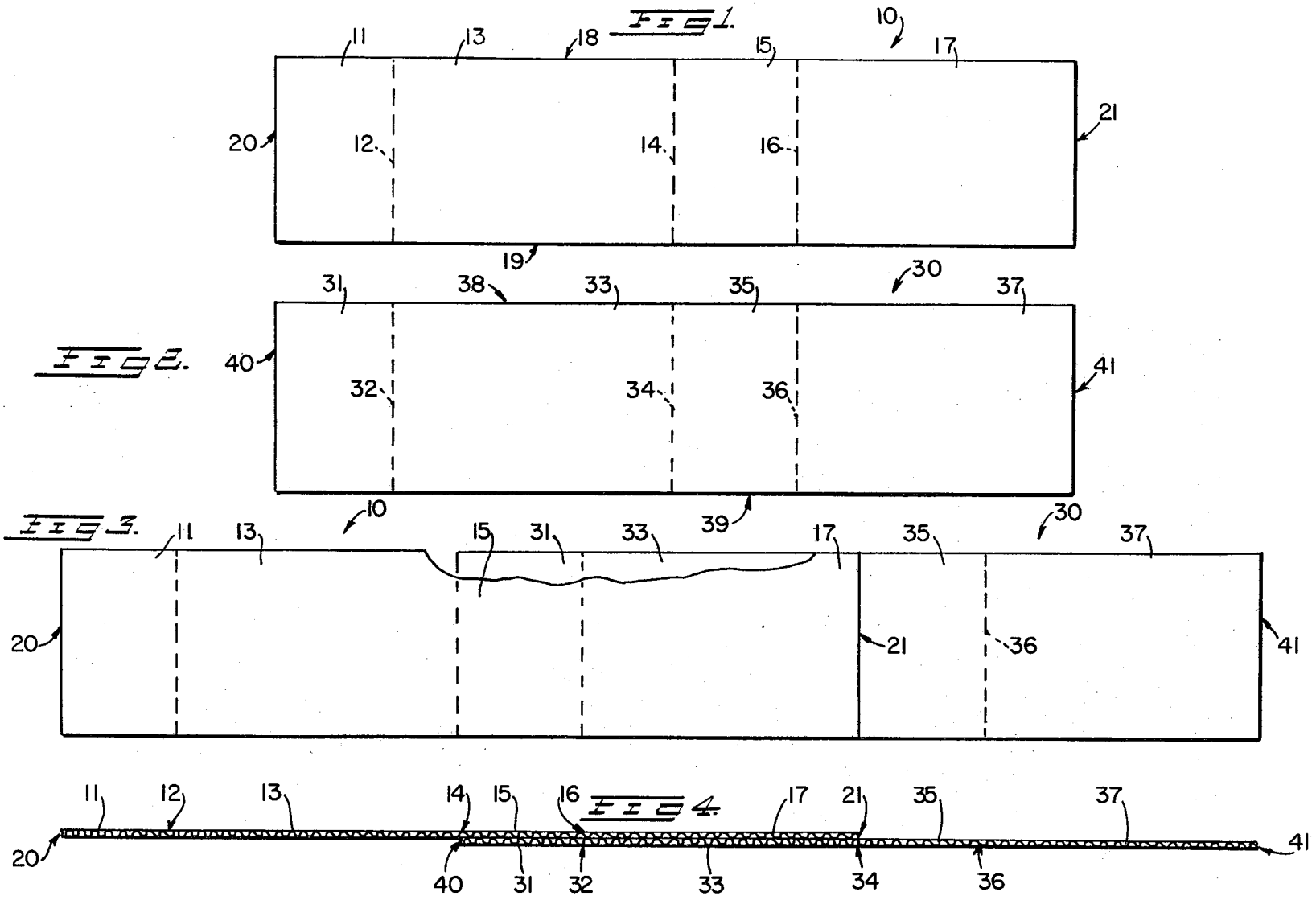
FIG. 1 is a plan view of a typical blank used to construct the body portion of the bulk material container.
FIG. 2 is a plan view of a second blank used to construct the body portion.
FIG. 3 is a plan view showing the blanks of FIGS. 1 and 2 superimposed in part.
FIG. 4 is an end view of the blanks in FIG. 3.

FIGS. 1 and 2 show a pair of substantially identical blanks of cut and scored paperboard 10 and 30, which may be used to construct the reinforced body portion 7 of the container of the present invention. Blank 10 is divided by parallel score lines 12,14 and 16 into a plurality of side wall panels 11,13,15 and 17. The blank 10 has an upper edge 18 and a lower edge 19 and a pair of ends 20,21. Blank 30 has substantially the same size and shape as blank 10 and is divided by parallel score lines 32,34,36 into a plurality of side wall panels 31,33,35 and 37. The blank 30 has upper and lower edges 38,39 and ends 40,41. The size of the respective side walls 11,13,15 and 17 and 31,33,35 and 37 are such that they may be arranged adjacent to one another to form a reinforced body portion for the bulk container. FIG. 3 illustrates the first step used to form the body portion 7.

Figure 5:
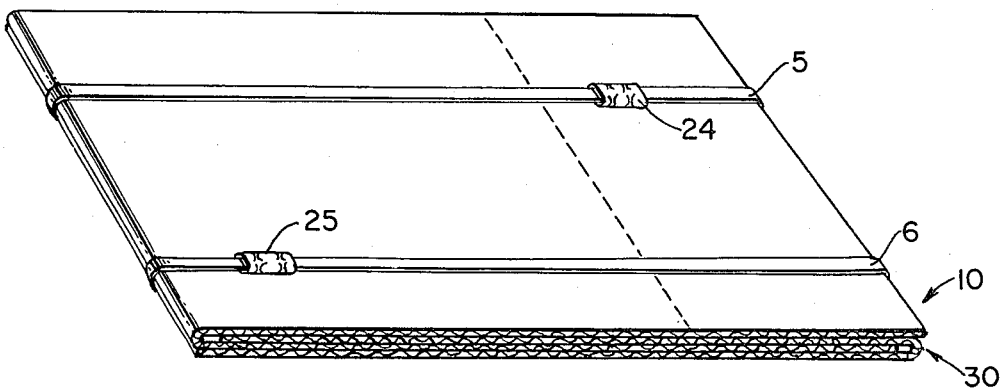
FIG. 5 is a perspective view of the folded, interleaved blanks shown in FIGS. 3 and 4 pre-banded in the knocked down or collapsed condition.
Figure 6:
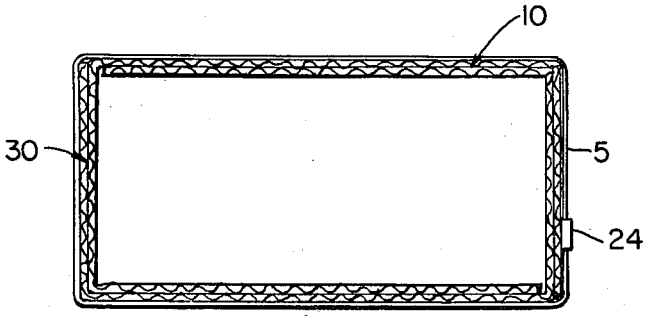
FIG. 6 is an end view of the squared body portion shown in FIG. 5.
Figure 7:
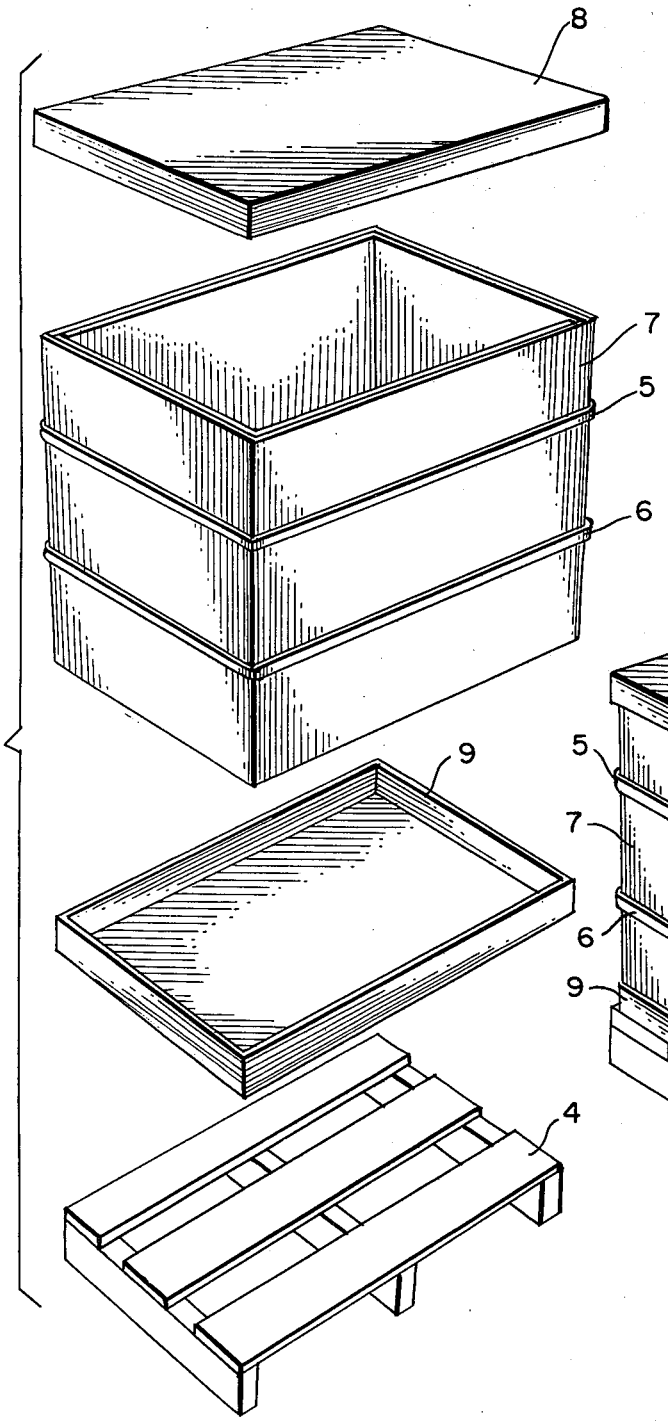
FIG. 7 is an expanded perspective view showing the component parts and their relationship for preparing the bulk material container.

For this purpose, the two blanks 10 and 30 are superimposed one on top of the other with their upper and lower edges 18,38 and 19,39 conterminous such that the panels 15 and 17 of blank 10 overlap panels 31 and 33 of blank 30 or vice versa. Meanwhile, the remainder of the respective blanks 10 and 30 extend outwardly beyond the superimposed portions. FIG. 4 shows an end view of this arrangement. As a next step in the manufacture of the body portion, the panels 35 and 37 of blank 30 are folded over to lie on top of the panels 15,17 of blank 10. Meanwhile, the panels 11 and 13 of blank 10 are folded over to lie on top of the panels 35,37 of blank 30. These steps produce a construction wherein the two blanks 10 and 30 are interleaved with one another such that the ends 20 and 21 of blank 10 are separated from one another by the blank 30 at score line 34, and the ends 40 and 41 of blank 30 are separated from one another by the blank 10 at score line 14. In this condition, the interleaved blanks 10 and 30 are pre-banded with straps 5 and 6 which are secured together by connectors 24,25 in their flat, knocked down condition. FIG. 5 shows the interleaved, pre-banded blanks 10 and 30 in their knocked down condition. For use, the body portion is squared as shown in FIG. 6 and inserted in the lower end cap 9 substantially as shown in the exploded view of FIG. 7. Note in FIG. 6 that the unsecured ends of the blanks 10 and 30 are located at diametrically opposed corners of the body portion.

Figure 9:
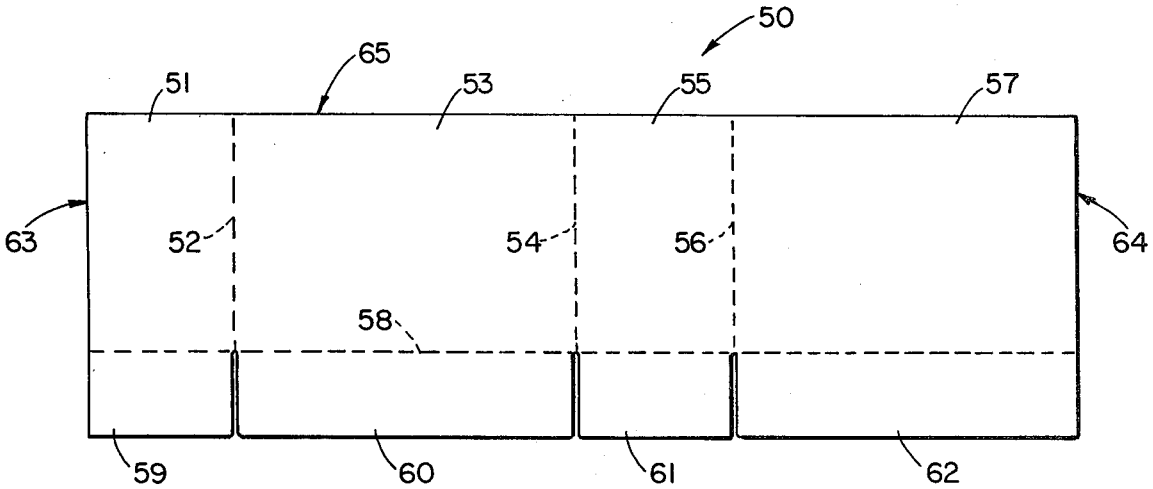
FIG. 9 is a plan view of a modified blank structure that may be used in place of one or both of the blanks shown in FIGS. 1 and 2.

In general, the body portion 7 is shipped to the user in the collapsed, pre-banded condition where suitable end caps 8 and 9 are available. The lower end cap 9 is placed on a suitable pallet 4 and the squared body portion 7 is inserted therein. The container is filled and the top cap 8 is placed over the upper end of the body portion. FIG. 8 shows the filled container ready to be picked up by a lift truck or the like.

Where desired, and for additional strength and sift proofness, the blanks used to form the body portion may be provided with end flaps. Blank 50 in FIG. 9 is divided into a plurality of panels 51,53,55 and 57 by score lines 52,54 and 56. Like the blanks 10 and 30 in FIGS. 1 and 2, blank 50 includes an upper edge 65 and ends 63,64. However, the bottom edge of blank 50 is provided with a plurality of edge flaps 59,60,61,62 separated from their respective panels 51,53,55 and 57 by a score line 58. Blanks of the type shown in FIG. 9 may be used to form side walls for the body portion with bottom flaps and/or top and bottom flaps.

The advantages of the pre-banded body portion are severalfold. First, by preapplying the straps 5 and 6, the user does not have to purchase and maintain strapping equipment. Secondly, the blanks are more easily pre-banded in their knocked down flat condition. If the container is filled and then banded, it might be difficult to restrain the already bulging side walls. Thirdly, by pre-banding the body portion, the ends of the two blanks do not have to be closed or sealed together with tape or the like at a conventional manufacturers joint. The elimination of this step makes the container of the present invention less expensive to make than similar containers known in the prior art. It is also desirable to have the two blanks which form the reinforced side walls separated from one another. When the side walls are rigidly adhered together in a bulk pack container, they have less flexibility than side-by-side yet unattached walls. Such a construction provides a more even distribution to loads applied to the container during stacking and shipping.

From the above, it can be seen that the present invention provides an improved bulk pack container for storing and shipping powdered or granular products over a wide load range. The addition of the pallet enables the bulk pack to be handled by a fork lift truck and the provision of pre-banding the body portion is a revolutionary step in bulk container design.

While only the preferred embodiment and one variation has been shown, it will be appreciated that changes may be made in the structure and method of manufacture as desired within the spirit and scope of the invention as defined in the appended claims.

I claim:

1. A bulk pack container adapted to be supported by a pallet or the like comprising, in combination, a body portion and a pair of first and second end caps, said body portion comprising side walls formed from a pair of rectangular wall forming blanks of material that are unsecured with respect to one another, said blanks having coterminous upper and lower edges and unsecured ends and being scored to provide at least four panels, said blanks being nested and interleaved with like panels overlapping one another so that the ends of each respective blank are separated from one another by a corner of the other respective blank to form a reinforced structure, and at least two bands of strapping material arranged around the outer periphery of said body portion in the knocked down condition, said bands being adapted to restrain the side walls and keep the side walls from bulging outwardly when the container is filled.

2. The container of claim 1 wherein said wall panels are pre-banded in the collapsed condition of said body portion.

3. The container of claim 2 wherein said wall forming blanks are made of corrugated paperboard.

4. The container of claim 3 wherein end closure flaps are provided on at least one edge of said wall forming blanks.

5. A combination pallet/bulk path container comprising, a pallet, a first end cap positioned on said pallet, a body portion for said bulk pack the lower end of which is inserted in said first end cap and a second end cap placed over the upper end of said bulk pack body portion, the improvement wherein said body portion is prepared as a pre-banded unit from a pair of precut and scored wall forming blanks of paperboard, said blanks being unsecured with respect to one another and having coterminous upper and lower edges and unsecured ends, said blanks being scored to provide at least four panels, said blanks being folded and interleaved together with like panels overlapping one another to produce a construction wherein the ends of each respective blank substantially abut one another but are spaced apart by a corner of the other respective blank, said walls being pre-banded so that the pre-applied bands may restrain the walls from bulging outwardly when the body portion is filled.

6. A method of forming the body portion of a bulk bin container comprising:

(a) providing a pair of generally rectangular flat blanks each scored along spaced parallel score lines to provide first and second side walls and first and second end walls;

(b) combining each of said flat blanks such that a first side wall and end wall of one blank is superimposed over a first side wall and end wall of the other blank with the ends of said blanks extending beyond said superimposed portions;

(c) folding and interleaving the ends of said blanks comprising the second side walls and end walls into superimposed position to produce a construction wherein the unsecured ends of each respective blank are separated from one another by a corner of the other respective blank; and, (d) pre-banding said folded and interleaved blanks in the knocked down condition to form a substantially flat, collapsed body portion that is readily squared for use.

* * * * *